US005242016A

United States Patent [19]

Voss et al.

[11] Patent Number: 5,242,016

[45] Date of Patent: Sep. 7, 1993

[54] LAMINATED PLATE HEADER FOR A REFRIGERATION SYSTEM AND METHOD FOR MAKING THE SAME

[75] Inventors: Mark G. Voss, Brighton; William O. Harvey, Cadillac, both of Mich.

[73] Assignee: Nartron Corporation, Reed City, Mich.

[21] Appl. No.: 862,517

[22] Filed: Apr. 2, 1992

[51] Int. Cl.[5] ..... F28F 9/02

[52] U.S. Cl. ..... 165/174; 165/173; 29/890.052

[58] Field of Search ..... 165/173, 174; 29/890.03, 890.052

[56] References Cited

U.S. PATENT DOCUMENTS

| | | | |
|---|---|---|---|
| 3,710,858 | 1/1973 | Young | 165/178 |
| 5,123,482 | 6/1992 | Abraham | 165/173 |

FOREIGN PATENT DOCUMENTS

| | | | |
|---|---|---|---|
| 2539857 | 7/1984 | France | 165/174 |
| 661231 | 5/1979 | U.S.S.R. | 165/174 |
| 890896 | 3/1962 | United Kingdom | 165/174 |

*Primary Examiner*—Allen J. Flanigan
*Attorney, Agent, or Firm*—Brooks & Kushman

[57] ABSTRACT

A laminated plate header, an evaporator and a method for making the same are disclosed. A plurality of plates, having passageways formed therein, are stacked together to form a laminate. The laminate is adapted to fluidly connect between a header inlet and core units of a heat exchanger in the evaporator. The plurality of plates are interleaved in a manner to index selected passageways of the plate such that refrigerant from the inlet is distributed through the passageways to the core units.

6 Claims, 4 Drawing Sheets

LAMINATED PLATE HEADER FOR A REFRIGERATION SYSTEM AND METHOD FOR MAKING THE SAME

TECHNICAL FIELD

The present invention relates generally to air conditioning system evaporators, and more particularly, to an improved header for selectively distributing refrigerant from an inlet of the evaporator to core units of the evaporator.

BACKGROUND ART

An air conditioning system typically includes a condenser, an evaporator, a pump and fluid circuit interconnecting these elements. The evaporator generally has a heat exchanger with a number of core units and a header which receives refrigerant from the fluid circuit and distributes refrigerant to each of the core units. The refrigerant is then returned to the fluid circuit.

Headers often include a plurality of conduits or tubes branching off of an inlet from the fluid circuit and connecting to openings in the core units. These headers attempt to distribute an even flow of refrigerant to the core units. The ends of the conduits are conventionally brazed in a hand assembly operation to the inlet and to each of the core units.

A number of problems are associated with the use of such headers. First, manufacture of these headers is labor intensive and is not well suited to automated manufacture. Each of the conduits must be individually brazed to the inlet and to the openings in each of the core units. This brazing is generally manually performed due to the awkward stalk-like configuration of the branching conduits.

Another problem results from the difficulty of distributing low pressure fluids. Because the length of the conduits between the inlet and the core units can vary, refrigerant passing through the header seeks the path of least resistance which is usually the shortest conduit. Accordingly, the quantities of refrigerant reaching each of the core units is not uniform thereby reducing the efficiency of the heat exchanger.

Also, this type of header is not particularly compact. Often numerous conduits are required to reach the appropriate openings in the core units. Therefore, packaging of the header in an evaporator unit can be difficult.

The present invention provides an improved header, evaporator and methods of making the same which solve some of the aforementioned problems.

SUMMARY OF THE INVENTION

An object of the present invention is an improved header for a refrigerant system evaporator which evenly distributes refrigerant from a header inlet to the evaporator thereby increasing its efficiency.

Another object of the present invention to provide a method for making the header which is well suited to automated manufacture.

A further object of the invention is to provide a header and evaporator which are more compact and more durable than headers and evaporators constructed using a plurality of individual conduits.

In carrying out the above objects and other objects, an improved evaporator header for selectively distributing refrigerant from a header inlet to the core units of a heat exchanger is provided. The header includes a plurality of plates sandwiched or stacked together to form a laminate. The laminate is adapted to fluidly connect between the header inlet and the core units of the heat exchanger. At least two of the plates in the laminate are made with passageways cut therethrough. The plurality of plates are interleaved in a manner indexing selected passageways of the plates, whereby to distribute refrigerant from the inlet through the passageways to the core units.

Preferably, at least one of the plates is a distributor plate with its passageways being elongated channels distributing the refrigerant laterally throughout the plate and to the passageways of an adjacent plate. Another of the plates is preferably a transfer plate with its passageways being transfer holes which allow refrigerant to pass therethrough to communicate with passageways of an adjacent plate. Ideally, the distributor and transfer plates are cooperatively and alternately stacked together to form the laminate with a convoluted or tortuous pathway therethrough.

A venturi or restriction may be placed in the channels of one or more of the distributor plates to equalize the flow of refrigerant throughout the passageways of the laminate. Accordingly, each of the core units receives approximately the same quantity of refrigerant thereby enhancing the efficiency of the heat exchanger.

The method of making a header for selectively distributing refrigerant from a header inlet to core units of the heat exchanger includes the following steps. First, a plurality of plates are formed having passageways therein. Next, the plates are sandwiched and interleaved in a manner to index selected passageways, whereby the refrigerant is distributed from the inlet through the passageways to the core units. The plates may be joined together to prevent fluid leakage from between the plates. The plates are preferably uniform in size and shape thereby permitting the joining to be performed in an automated operation. If the plates are metallic, the plates may be brazed together.

The present invention also includes an improved evaporator. The evaporator includes the header described above. Passageways in a plate adjacent the core units of a heat exchanger are brazed to corresponding openings in the core units to fluidly connect the header to the heat exchanger.

The above objects and other objects, features and advantages of the present invention can be more fully understood and appreciated with reference to the following drawings, descriptions and claims.

BEST MODE FOR CARRYING OUT THE INVENTION

Figure 1:
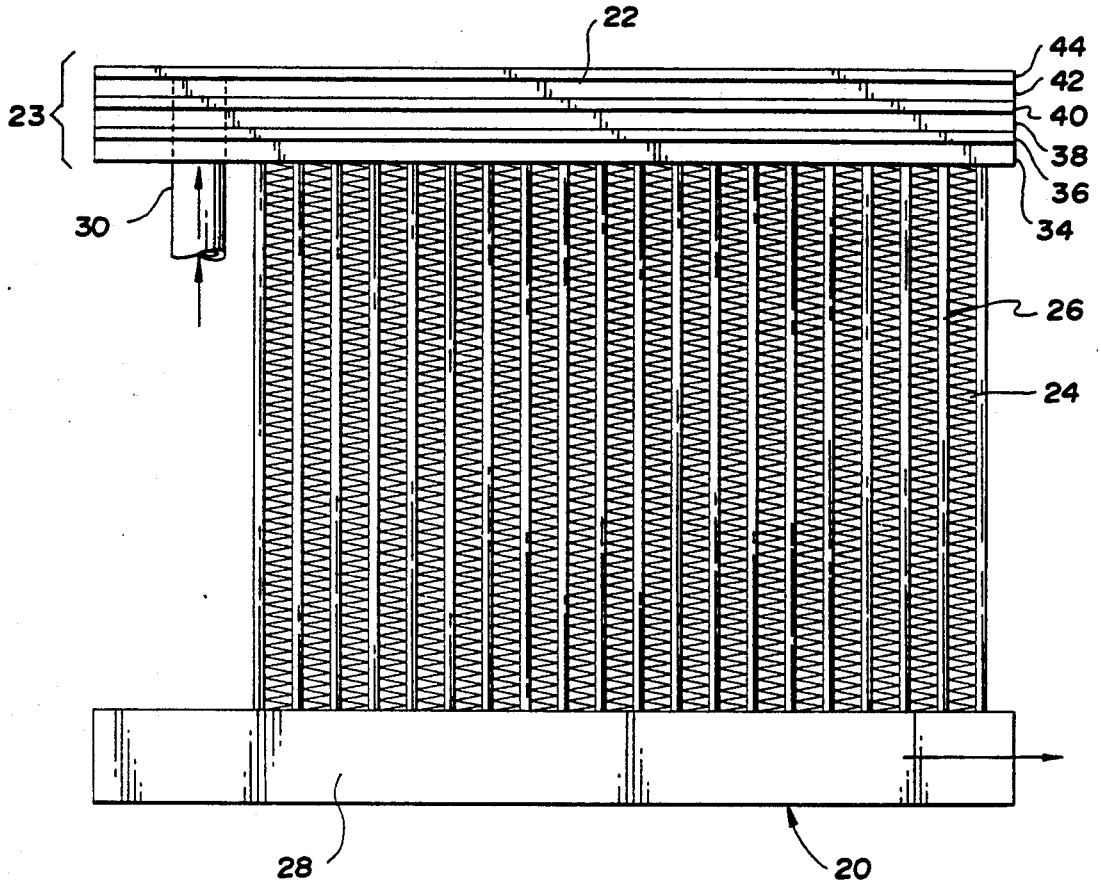
FIG. 1 is a side view of an evaporator having a header and heat exchanger made in accordance with the present invention.

Referring to FIG. 1 of the drawings, an improved evaporator for an air conditioning system is generally indicated by reference numeral 20. As is hereinafter more fully described, an improved header 22 leads itself to automated assembly and more efficient distribution of low pressure refrigerant.

FIG. 1 shows an evaporator 20 having a header 22 and a heat exchanger 24. The evaporator 20 is used in conjunction with an external expansion device (not shown). Boiling begins external to the evaporator inlet aperture and occurs in all locations in the header 22. This is necessary to assure good volume flow in the passages regardless of refrigerant mass flow.

Header 22 includes a plurality of sandwiched plates which form a laminate 23. Heat exchanger 24 has a number of parallel core units 26 which are fluidly connected to a collector base 28. Refrigerant enters a header inlet 30, which is brazed to header 22. The refrigerant then passes through a convoluted pathway (not shown) in header 22, which will be described below, and is distributed to the various core units 26. Collector base 28 collects refrigerant exiting the core units 26. The refrigerant then exits the collector base 28 as indicated by the arrow in FIG. 1.

Figure 2:
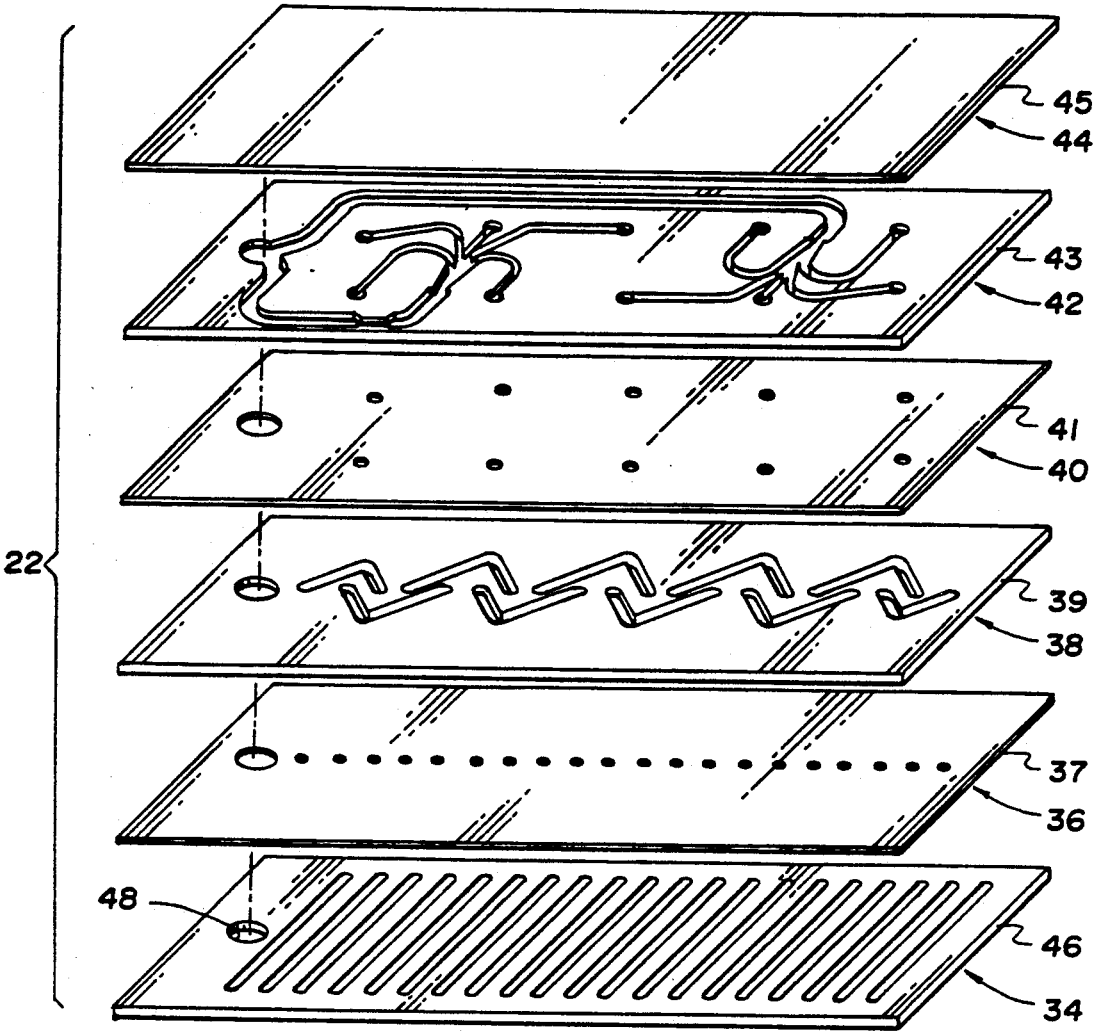
FIG. 2 is an exploded perspective view of the header defined by a plurality of plates as illustrated.

FIG. 2 shows an exploded view of the header 22. In the preferred embodiment, header 22 includes a bottom distributor plate 34, a first transfer plate 36, an intermediate distributor plate 38, a second transfer plate 40, a top distributor plate 42 and a cap plate 44. The distributor plates in the preferred embodiment are 0.125" thick and the orifice plates 0.035" thick. Plates 34, 36, 38, 40, 42 and 44 are preferably rectangular in shape and have respective peripheries 35, 37, 39, 41, 43 and 45.

The plates are ideally made of aluminum with their contacting surfaces being brazed together to form laminate 23. Because the plates are uniform in shape and size, they may be easily manufactured using a robot or other automated means to secure and seal these plates together. It is also within the scope of the invention to use plates with other sizes and shapes, such as a circular shape, or other materials, such as other metals or even plastics or ceramics.

In the present embodiment, aluminum, preclad with braze alloy is used for header 22 construction. When the header laminate 23 is stacked, clamped, and placed in a braze furnace, the braze alloy flows to seal the perimeter as well as contacting land surfaces.

Figure 4:
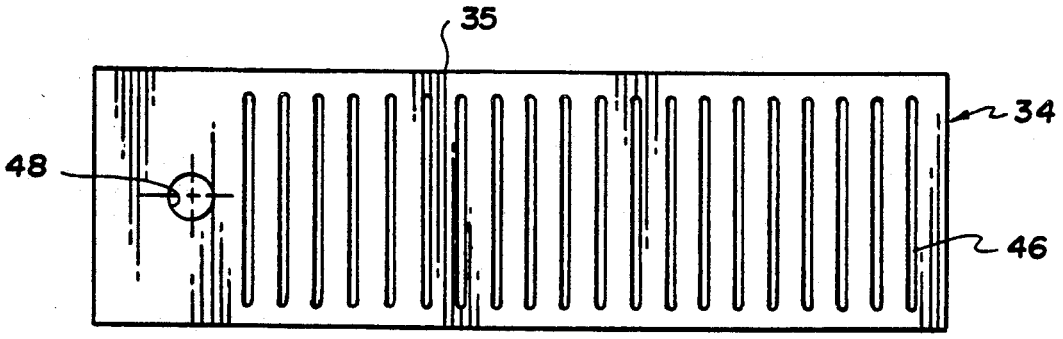
FIG. 4 is a plan view of a bottom distributor plate.

With reference to FIG. 4, bottom distribution plate 34, bounded by periphery 35, includes a plurality of parallel elongated channels 46 and an inlet aperture 48. Channels 46 are configured and sized to correspond to openings in the top of core units 26. These openings and channels 46 are joined together to provide fluid communication between the heat exchanger 24 and the header 22. Aperture 48 is sized to receive header inlet 30, which preferably is a circular tube.

Figure 5A:
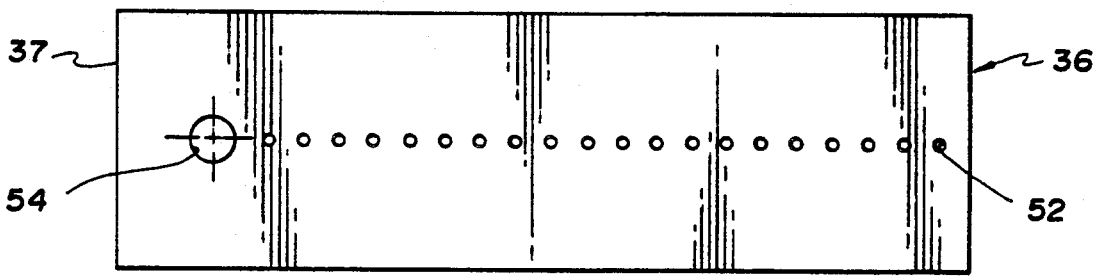
FIG. 5A is a plan view of a first transfer plate.
Figure 5B:
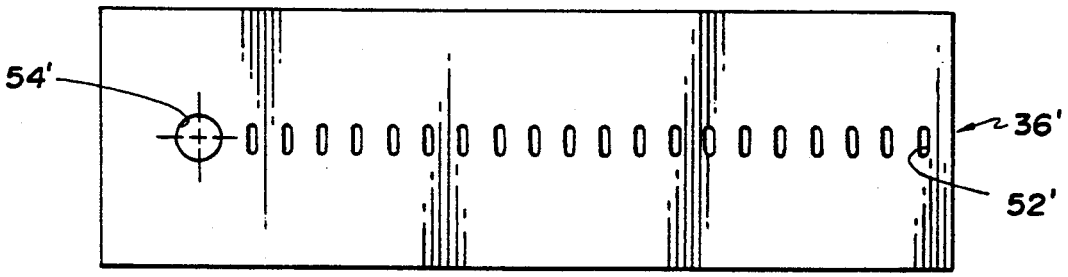
FIG. 5B is a plan view of an alternative embodiment of the first transfer plate.

FIG. 5A shows a first embodiment of first transfer plate 36 which has circular transfer holes 52 and an inlet aperture 54. Each of the transfer holes 52 corresponds to one of the channels 46 of bottom distribution plate 34. Likewise, inlet aperture 54 is coaxially aligned with inlet aperture 48. FIG. 5B shows an alternative embodiment wherein transfer holes 52' are elongated rather than circular.

Figure 6:
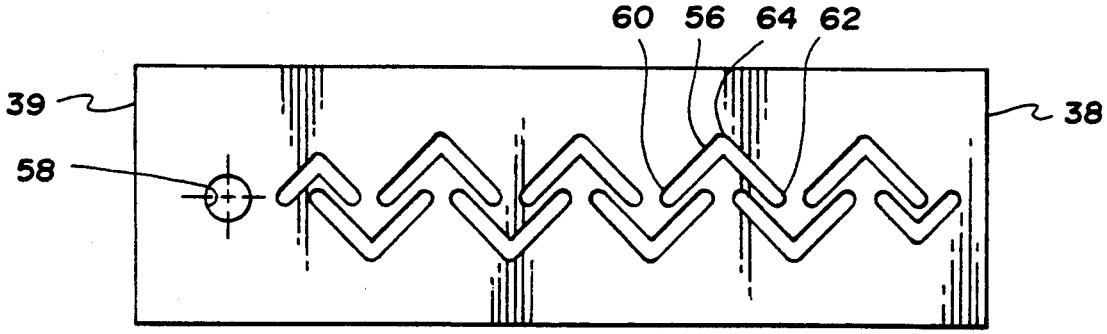
FIG. 6 is a plan view of an intermediate distributor plate.

Intermediate distribution plate 38 is shown in FIG. 6. First distribution plate 38 includes L-shaped channels 56 and an inlet aperture 58. Each of the L-shaped channels 56 includes first and second terminal ends 60 and 62 and intermediate bight portions 64. The first and second terminal ends 60 and 62 are arranged along the longitudinal centerline of plate 38 and are coaxially alignable with openings 52 or 52' of first transfer plate 36.

Figure 7:
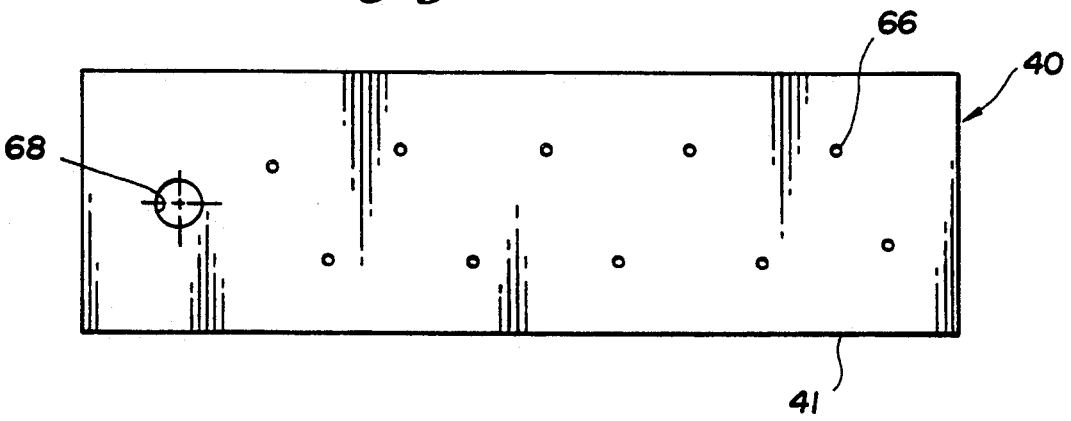
FIG. 7 is a plan view of a second transfer plate.

Second transfer plate 40 is illustrated in FIG. 7 and has a plurality of spaced transfer holes 66 and an inlet aperture 68. Transfer holes 66 and inlet aperture 68 are formed such that they are respectively coaxially alignable with the intermediate bight portion 64 of L-shaped channels 56 and inlet aperture 58 of intermediate distribution plate 38.

Figure 8:
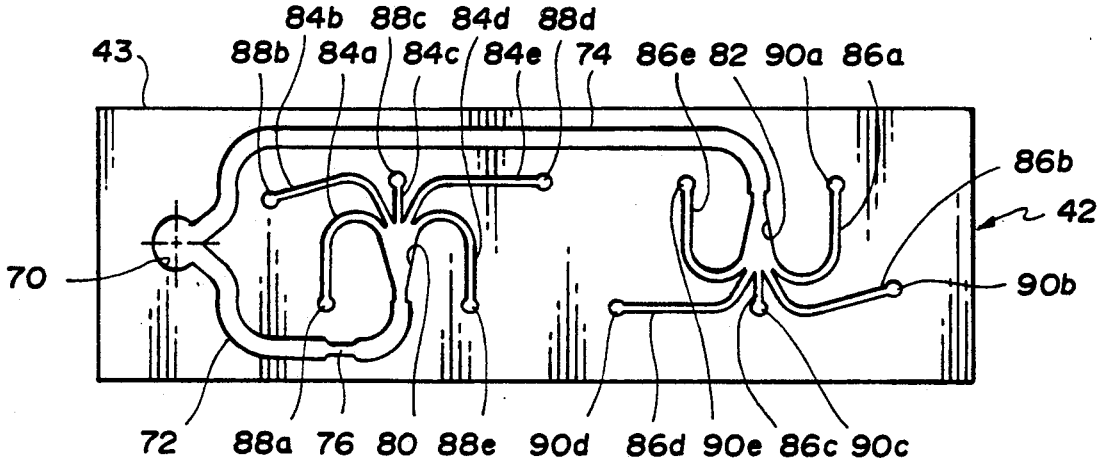
FIG. 8 is a plan view of a top distributor plate.

Top distribution plate 42 is shown in FIG. 8 having periphery 43 and inlet aperture 70. First and second channels 72 and 74 bifurcate from inlet aperture 70. First and second expansion chambers 80 and 82 are formed in the channels 72 and 74. Branching from the expansion chambers 80 and 82 are first and second secondary channels 84*a*, 84*b*, 84*c*, 84*d* and 84*e* and 86*a*, 86*b*, 86*c*, 86*d* and 86*e*. Each of the first and second secondary passageways 84*a–e* and 86*a–e* terminates in enlarged ends 88*a–e* and 90*a–e*, respectively. Enlarged ends 88*a–e* and 90*a–e* correspond coaxially with transfer holes 66 of second transfer plate 40.

A venturi 76 is formed in the shorter length channel 72 to provide a flow restricting balancer which equalizes the quantity of refrigerant reaching each of the expansion chambers 80 and 82.

Figure 9:
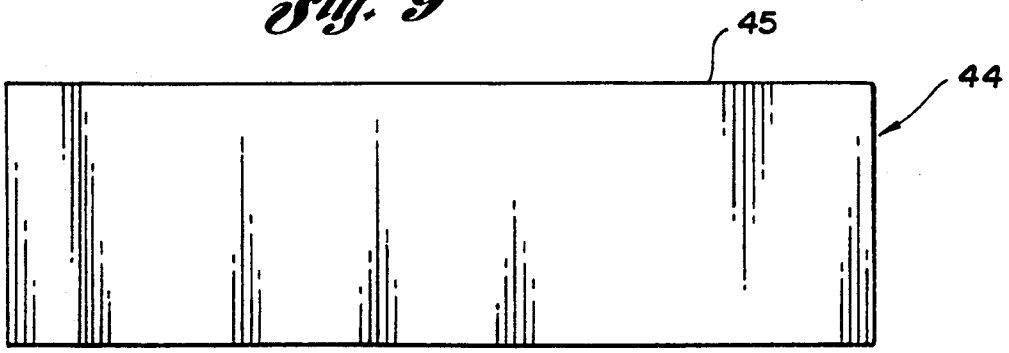
FIG. 9 is a plan view of a cap plate.

The final plate of header 22 is cap plate 44, shown in FIG. 9, which has no transfer holes or channels. Periphery 45 of plate 44 is the same size and shape as the peripheries of the other plates 34, 36, 38, 40 and 42.

Figure 3:
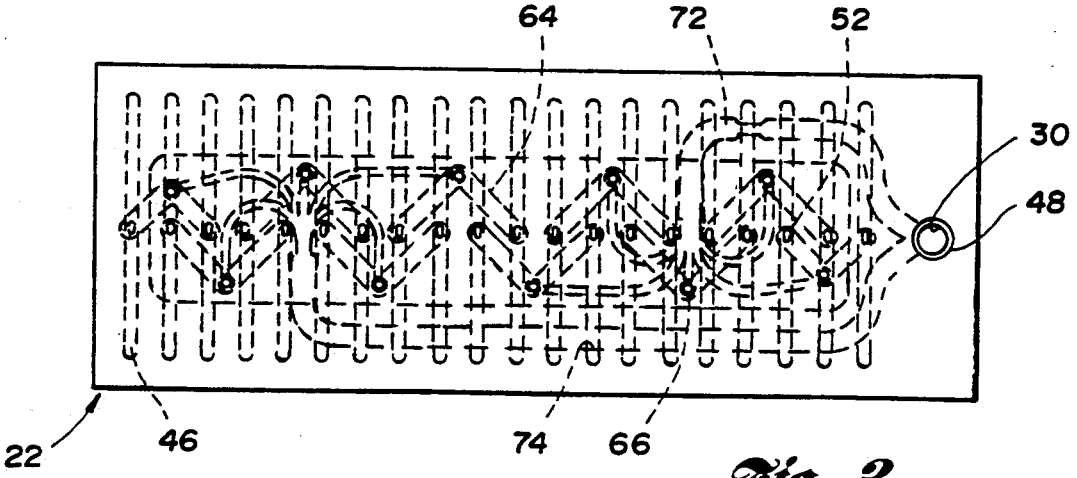
FIG. 3 is an illustrative view of the header showing passageways as hidden lines.

FIG. 3 shows a bottom view of laminate 23. Plates 34, 36, 38, 40, 42 and 44 are interleaved in a manner to index selected passageways of the plates whereby to distribute refrigerant from the inlet 30 to the core units 26 of heat exchanger 24. Shown in hidden lines are the various transfer holes and channels through which the refrigerant flows.

In operation, refrigerant enters header inlet 30, passes through each of the coaxially aligned inlet apertures 48, 54, 58, 68 and 70, reaching top distribution plate 42. Refrigerant then flows along first and second channels 72 and 74 to first and second expansion chambers 80 and 82. The venturi 76 is sized to provide equal flow to each of the expansion chambers 80 and 82. In theory, refrigerant in a boiling state reaches expansion chambers 80 and 82 where the refrigerant fills the volume of the chambers 80 and 82, and mechanically evenly distributes to first and secondary channels 84*a–e* and 86*a–e* and to enlarged ends 88*a–e* and 90*a–e*. Accordingly, equal quantities of refrigerant are eventually delivered to each of the core units 26.

Refrigerant then travels downward through the plurality of transfer holes 66 of second transfer plate 40 to the intermediate bight portions 64 of the L-shaped channels 56. Next, refrigerant flows to terminal end portions 60 and 62 located along the longitudinal center line of plate 38. Refrigerant then passes downward through transfer holes 52 of first transfer plate 36 to channels 46 which are in fluid communication with core units 26. From there, refrigerant passes through to the core units 26 and is collected in collection base 28 and may then exit the evaporator 20.

Looking to FIG. 3, L-shaped channels 56 are shown overlapping one another such that the first and second terminal end portions 60 and 62 direct refrigerant to non-adjacent core units 30. Therefore, hot and cold core units are not next to one another.

Plates 34, 36, 38, 40 and 42 preferably have their orifices and channels formed therein by using a numerically controlled cutting apparatus. Alternatively, the plates could also be stamped to form the passageways. If the material permits, the plates, formed singularly or in multiples, may have the channels molded or die cast during plate formation.

The method of making header 22 for selectively distributing refrigerant from the header inlet 30 to the core units 26 of heat exchanger 24 includes the following steps. Forming plates 34, 36, 38, 40 and 42 with the appropriate transfer holes or channels therein. Next, plates 34, 36, 38, 40 and 42, along with cap plate 44 are then interleaved or stacked in a manner to index the channels and transfer holes whereby to distribute refrigerant from inlet 30 to the core units 26. To prevent leakage from the header 22, the peripheries 35, 37, 39, 41, 43 and 45 are joined together to form laminate 23. If metal plates are used, brazing is preferably used to join the plates together.

Evaporator 20 is manufactured by making header 22, as described above, and fluidly connecting heat exchanger 24 thereto. Preferably, this is done by joining respective top openings in core units 26 to the channels 46 of bottom distributer plate 34. Bottom openings in core units 26 are fluidly connected to collector base 28 to collect refrigerant leaving the core units 26.

While in the foregoing specification this invention has been described in relation to certain preferred embodiments thereof, and many details have been set forth for the purpose of illustration, it will be apparent to those skilled in the art that the invention is susceptible to alteration and that certain other details described herein can vary considerably without departing from the basic principles of the invention. For example, a different number of plates maybe used. Also, the pathway created by the indexed passageways may be composed of different combinations of orifices and channels formed in the plates. Seals may be interposed between the plates to prevent fluid leakage from between the peripheries of plates.

While the best mode for carrying out the invention has been described in detail those familiar with the art to which this invention relates will recognize various alternative embodiments for practicing the invention as defined by the following claims.

What is claimed is:

1. An improved header for selectively distributing refrigerant from a header inlet to the core units of a heat exchanger, said header comprising:

a plurality of plates stacked together to form a laminate, said laminate adapted to fluidly connect between said header inlet and said core units of said heat exchanger;

at least two of said plates in said laminate having passageways;

at least one of said plates being a distributor plate with its passageways being defined by a first channel and secondary channels branching from said first channel for distributing the refrigerant laterally throughout said plate; said distributor plate also including a first expansion chamber in fluid communication between said first channel and said secondary channels whereby fluid expands in said first chamber;

at least one of said plates being a transfer plate with its passageways being transfer holes; and said plurality of plates being interleaved in a manner to index selected passageways of said plates, whereby to distribute refrigerant from said inlet through said passageways to said core units.

2. The invention of claim 1 wherein said distributor plate includes a second channel bifurcated from said first channel; said second channel also having secondary branching channels and a second expansion chamber in fluid communication therebetween; at least one of said channels including a venturi formed therein for equalizing the flow of refrigerant reaching its associated expansion chamber relative to the other expansion chamber thereby equalizing the flow of refrigerant exiting said secondary branch channels to an adjacent plate.

3. An improved header for selectively distributing refrigerant from a header inlet to the core units of a heat exchanger, said header comprising:

a plurality of plates stacked together to form a laminate, said laminate adapted to fluidly connect between said header inlet and said core units of said heat exchanger;

at least two of said plates in said laminate having passageways;

at least one of said plates being a distributor plate with its passageways being defined by a bifurcated channel with first and second branches for distributing the refrigerant laterally throughout said plate; one of said branches including a venturi formed therein thereby equalizing the flow of refrigerant exiting from each branch to an adjacent plate;

at least one of said plates being a transfer plate with its passageways being transfer holes; and said plurality of plates being interleaved in a manner to index selected passageways of said plates, whereby to distribute refrigerant from said inlet through said passageways to said core units.

4. A method of making a header for selectively distributing refrigerant from a header inlet to the core units of a heat exchanger, the method comprising the steps of:

forming a plurality of plates having passageways therein;

forming at least one distributor plate with its passageways being defined by a first channel and secondary channels branching from said first channel with a first expansion chamber in fluid communication between said first channel and secondary channels; and interleaving the plates into a laminate in a manner to index said passageways, whereby to distribute refrigerant from said inlet through said passageways to said core units.

5. The method of claim 4 wherein:

the step of forming the distributor plate includes forming a second channel having secondary branching channels and a second expansion chamber in fluid communication therebetween; said second channel being in fluid communication with said first channel; and forming a venturi in one of said channels thereby to equalize the flow of refrigerant reaching its associated expansion chamber relative to the other expansion chamber.

6. A method of making a header for selectively distributing refrigerant from a header inlet to the core units of a heat exchanger, the method comprising the steps of:

forming a plurality of plates having passageways therein;

forming at least one distributor plate with its passageways being defined by a bifurcated channel with first and second branches;

forming a venturi in one of said branches thereby equalizing the flow of refrigerant exiting from each branch to an adjacent plate;

interleaving the plates into a laminate in a manner to index said passageways, whereby to distribute refrigerant from said inlet through said passageways to said core units.

* * * * *